United States Patent [19]

Iwasaki

[11] Patent Number: 4,938,200

[45] Date of Patent: Jul. 3, 1990

[54] IGNITION DEVICE

[75] Inventor: Shinichiro Iwasaki, Anjo, Japan

[73] Assignee: Aisin Seiki Kabushiki Kaisha, Aichi, Japan

[21] Appl. No.: 290,062

[22] Filed: Dec. 27, 1988

[30] Foreign Application Priority Data

Dec. 26, 1987 [JP] Japan ..... 62-330667

[51] Int. Cl.[5] ..... F02P 3/04

[52] U.S. Cl. ..... 123/620; 123/606; 123/643

[58] Field of Search ..... 123/620, 643, 606, 607, 123/637

[56] References Cited

U.S. PATENT DOCUMENTS

| | | | |
|---|---|---|---|
| 3,426,740 | 2/1969 | Hufton et al. | 123/643 |
| 3,452,733 | 7/1969 | Eckert | 123/620 |
| 3,645,246 | 2/1972 | Campbell et al. | 123/620 |
| 4,326,493 | 4/1982 | Merrick | 123/620 |

FOREIGN PATENT DOCUMENTS

| | | | |
|---|---|---|---|
| 2309632 | 9/1974 | Fed. Rep. of Germany | 123/620 |

*Primary Examiner*—Andrew M. Dolinar

*Attorney, Agent, or Firm*—Sughrue, Mion, Zinn, Macpeak & Seas

[57] ABSTRACT

An ignition device for an internal combustion engine comprising an electromagnetic energy accumulator, a power source for supplying electromagnetic energy to the electromagnetic energy accumulator increasing an electromgnetic supplying line, a switching device responsive to rotation of the engine for controlling the supply of energy from the power source to the accumulator, a transformer having a primary winding connected to the accumulator, and a secondary winding for inducing a flow of electromagnetic energy in the secondary winding in response to the flow of electromagnetic energy in the primary winding, a rectifier for controlling the direction of flow of the electromagnetic energy in the primary winding and a spark generator connected to the secondary winding of the transformer for generating an electric spark in response to the energy flowing in the secondary winding.

8 Claims, 4 Drawing Sheets

IGNITION DEVICE

FIELD OF THE INVENTION

This invention relates to an ignition device for an internal combustion engine, and more particularly to an inductive discharge ignition device.

DESCRIPTION OF THE PRIOR ART

Recently, higher efficiency and a better igniting effect are required for an ignition device to achieve higher power and fuel efficiency in an engine for a vehicle. The ignition device shown in FIG. 5 is an example of such a device. This device is described in a paper entitled "Programmable Energy Ignition System For Engine Optimization" published in SAE Technical Paper Ser. No. 750348 (1975).

The ignition device shown in FIG. 5 is described as an improvement of an inductive discharge type full transistor ignition device. The device in FIG. 5 comprises an ignition coil 60, a distributor 63, a switching transistor Tr connected to the ground of a primary winding 61 of the ignition coil 60, and a drive circuit 10 for driving the switching transistor Tr.

The drive circuit 10 has a magnetic pick-up 11, a pick-up coil 12, a waveform shaping circuit 13, an arc duration control circuit 14, a comparator 15, an off-time control circuit 16 and a drive gate 17.

The pick-up 11 has eight magnetic poles 11*a*. The pick-up 11 is fixed to a rotor (not shown) of the distributor 63. The rotor is rotated by the crank shaft of the engine. The pick-up coil 12 is positioned near the magnetic pick-up 11 to detect the passage of each magnetic pole. Electromotive force is generated by the changes of interlinkage magnetic flux caused by rotation of the magnetic pick-up 11. The electromotive force is shaped by the waveform shaping circuit 13 into pulses for triggering the arc duration control circuit 14. In FIG. 5, a monostable multi-vibrator is used as the arc duration control circuit 14. The monostable multi-vibrator sends an arc duration pulse a to one input port of the drive gate 17. The pulse width of the arc duration pulse a is about 75 milliseconds.

The comparator 15 compares the voltage between each end of a shunt resistor R and reference voltage Ref. The shunt resistor R is connected between the emitter of the power transistor Tr and ground. The comparator 15 sends a low level voltage to the off-time control circuit 16 when the voltage of the shunt resistor R is higher than the reference voltage Ref and sends a high voltage when the voltage of the shunt resistor R is lower than the reference voltage Ref. The off-time control circuit 16 is a monostable multi-vibrator in this SEA technical paper. The off-time control circuit 16 sends a low level off-time control pulse b which has a short duration (substantially less than 75 milliseconds) when the output of the comparator 15 is turned to a high level from a low level. The off-time control pulse b is sent to the other input port of the drive gate 17.

The drive gate 17 is an AND gate. The drive gate 17 outputs a high level drive pulse for driving the switching transistor Tr. The transistor Tr turns on when both the arc duration pulse a and the off-time control pulse b are high level.

Referring to FIG. 6, when the arc duration pulse a is a low level, then the drive pulse from the drive gate 17 turns the switching transistor Tr off. Thus, current d flowing in the primary winding 61 of the ignition coil 60 becomes zero, and the off-time control pulse b changes to a high level. In this state, when the pick-up coil 12 detects a magnetic pole 11*a* of the magnetic pick-up 11, the arc duration control circuit 14 sends a high level arc duration pulse a shaped by the waveform shaping circuit 13 and having a predetermined voltage level. The drive gate 17 changes the drive pulse to a high level and the switching transistor Tr is turned on. Therefore, the current d flowing in the primary winding 61 increases gradually and the voltage between the terminals of the shunt resistor R rises. When the voltage is equal to the reference voltage Ref which corresponds to a threshold current value Lr of the primary winding 61, the comparator 15 changes its output to a high level. Therefore, the off-time control circuit 16 changes the off-time control pulse b to a low level, the drive gate 17 changes the drive pulse to a low level and the switching transistor Tr is turned off. When the switching transistor Tr turns off, the energy stored at the primary winding 61 of the ignition coil 60 is conveyed directly to the secondary winding 62 and high voltage is generated on the secondary winding 62. In FIG. 6, the voltage e is negative, but this depends on the winding direction of the coils 61 and 62. The voltage e is supplied to a spark plug SP1 selected by the distributor 63 and a spark electric discharge is generated by dielectric breakdown. After that, the off-time control circuit 16 changes the off-time control pulse b to a high level again after the lapse of the off-time, so that the switching transistor Tr is turned on and the primary winding 61 is charged the same as in the above explanation. At this point, the gas in the cylinder is plasma, so the opposite direction spark electric discharge is generated at the spark plug SP1 by the secondary voltage generated by transformer effect of the ignition coil 60. After that, the above action is repeated when the arc duration pulse a is a high level.

Accordingly, in the ignition device of FIG. 5, the positive and negative spark electric discharge is repeated, and the spark energy is maintained continuously as shown in g of FIG. 6 during the time set in the arc duration control circuit.

In the above ignition device, the spark holding voltage which is necessary to hold the spark electric discharge in the spark plug SP1 after the dielectric breakdown corresponds to pressure, temperature, and other characteristics of the mixed gas in the cylinder. The secondary voltage in the secondary winding 62 during the charging time of the primary winding 61 corresponds to the power supply voltage (+12V). Accordingly, it is necessary to set the turning ratio of the ignition coil 60 so that the secondary voltage equals a maximum value of the spark holding voltage so as to continue the spark electric discharge. For this reason, the spark current can be excessive if the secondary voltage during the charge time is larger than the required spark holding voltage. To prevent this problem it is necessary to have a dummy load Rr. On the other hand, the charged energy on the primary winding 61 is decreased by the amount of energy expended on the secondary side during the charge time of the primary winding 61. A sufficient spark electric discharge cannot be guaranteed with such a decreased energy charge. In the above ignition device, the charge energy of the primary winding 61 is effected by the state of the gas or the voltage level of the power supply, so that the spark current varies and the spark electric discharge is unstable.

The above problem is caused by the energy consumption in the secondary side during the charge time of the primary winding 61. This problem has been presented whenever one spark electric discharge is produced in one ignition timing duration. As the way to solve the problem, an ignition device having a diode in the secondary side has been used. The diode limits the direction of the flow of the spark current and decreases the energy loss on the secondary side. However, the diode must withstand a high voltage. This kind of diode is expensive and large. Further, the structure of the secondary side must be more complex, so that a leak is apt to be generated from the diode.

SUMMARY OF THE INVENTION

Accordingly, it is an object of the invention to provide an ignition device which is less expensive, more reliable and efficient. Another object of the invention is to improve the igniting efficiency of an ignition device without increasing the size of the secondary side.

Further and other objects of this invention will become obvious upon an understanding of the illustrative embodiments about to be described or will be indicated in the appended claims, and various advantages not referred to herein will occur to one skilled in the art upon employment of the invention in practice.

DETAILED DESCRIPTION OF THE INVENTION

Figure 1:
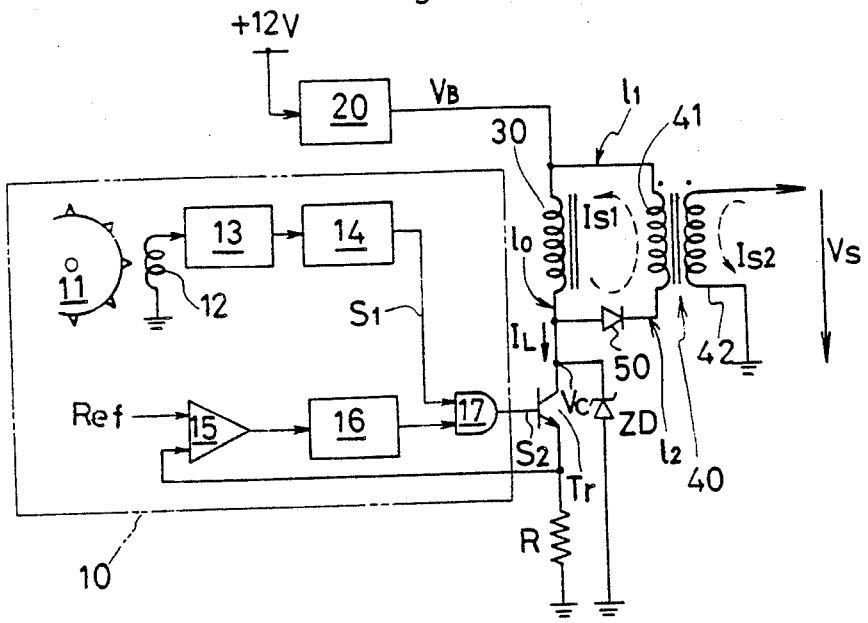
FIG. 1 shows a block diagram of the ignition device according to a first embodiment of the present invention.

In the exemplary embodiment of the invention as disclosed in the drawings, FIG. 1 illustrates an ignition device according to a first embodiment. This ignition device has an inductance coil 30, a DC-DC converter 20, a switching transistor Tr, a shunt resistor R, a drive circuit 10, a transformer 40 and a diode 50. The DC-DC converter 20 raises 12 volt battery voltage to about 60 volts, and the DC-DC converter 20 supplies charge voltage VB to the conductance coil 30. The switching transistor Tr and the shunt resistor R are inserted in the ground line of the inductance coil 30. The drive circuit 10 drives the switching transistor Tr. The transformer 40 has a primary winding 41 and a secondary winding 42. Each end of the primary winding 41 is connected to each end of the inductance coil 30. The diode 50 is inserted in a connection line 12 between the inductance coil 30 and the primary winding 41. The secondary winding 42 is connected to a distributor (not shown).

Figure 5:
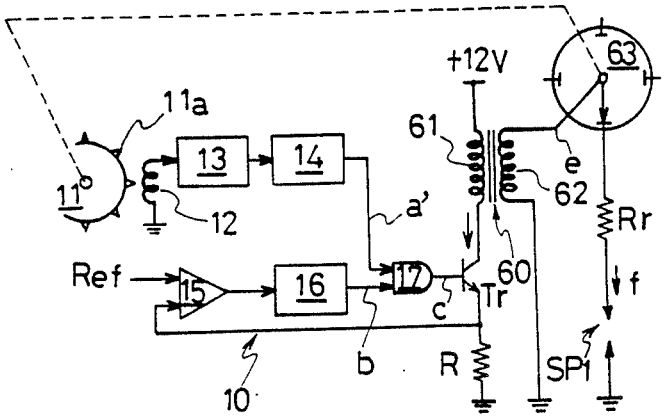
Fig.5 PRIOR ART
FIG. 5 shows a block diagram of the ignition device of a prior art system.
Figure 6:
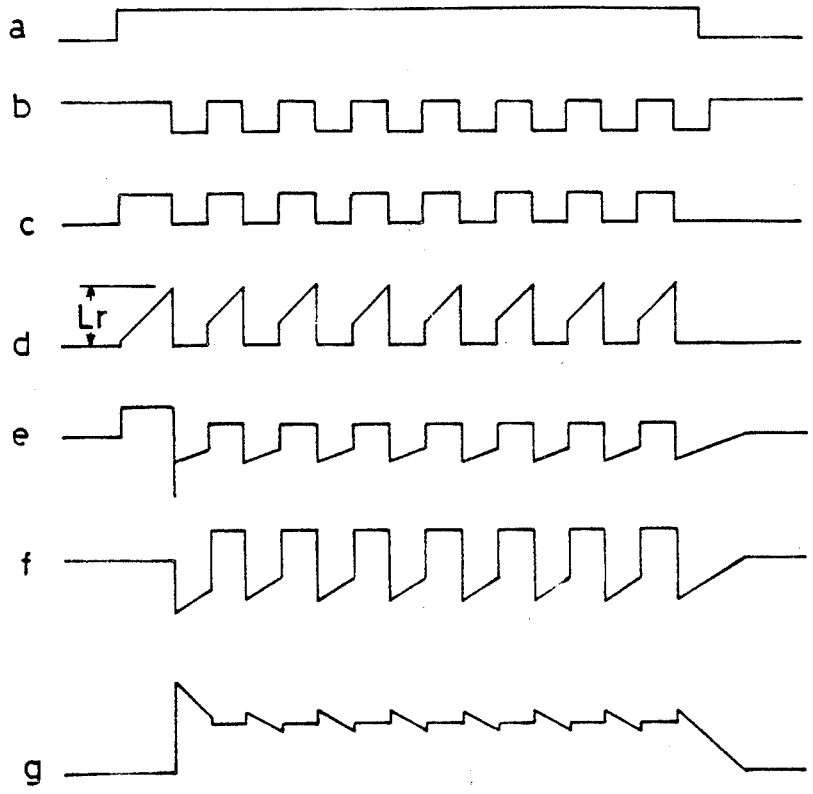
Fig.6 PRIOR ART
FIG. 6 shows a waveform diagram of the waveform of each part of the ignition device in FIG. 5.

A construction of the drive circuit 10 is nearly equal to the construction of the drive circuit of the ignition device in FIG. 5. The drive circuit 10 in FIG. 1 sues a flip-flop instead of the arc duration control circuit 14 in FIG. 5. The magnetic pick-up 11 has magnetic poles. A plus pulse is generated in the pick-up coil 12 at the igniting timing. A minus pulse is generated in the pick-up coil 12 at the end of the arc duration term. The pulse is shaped at the waveform shaping circuit 13. The shaped pulse is discriminated by a diode, sets the flip-flop by positive edge thereof, and resets the flip-flop by negative edge thereof (The negative edge is falling from high level to low level of the pulse). Accordingly, the output of the flip-flop is related to the arc duration pulse according to the speed of engine rotation.

Figure 2:
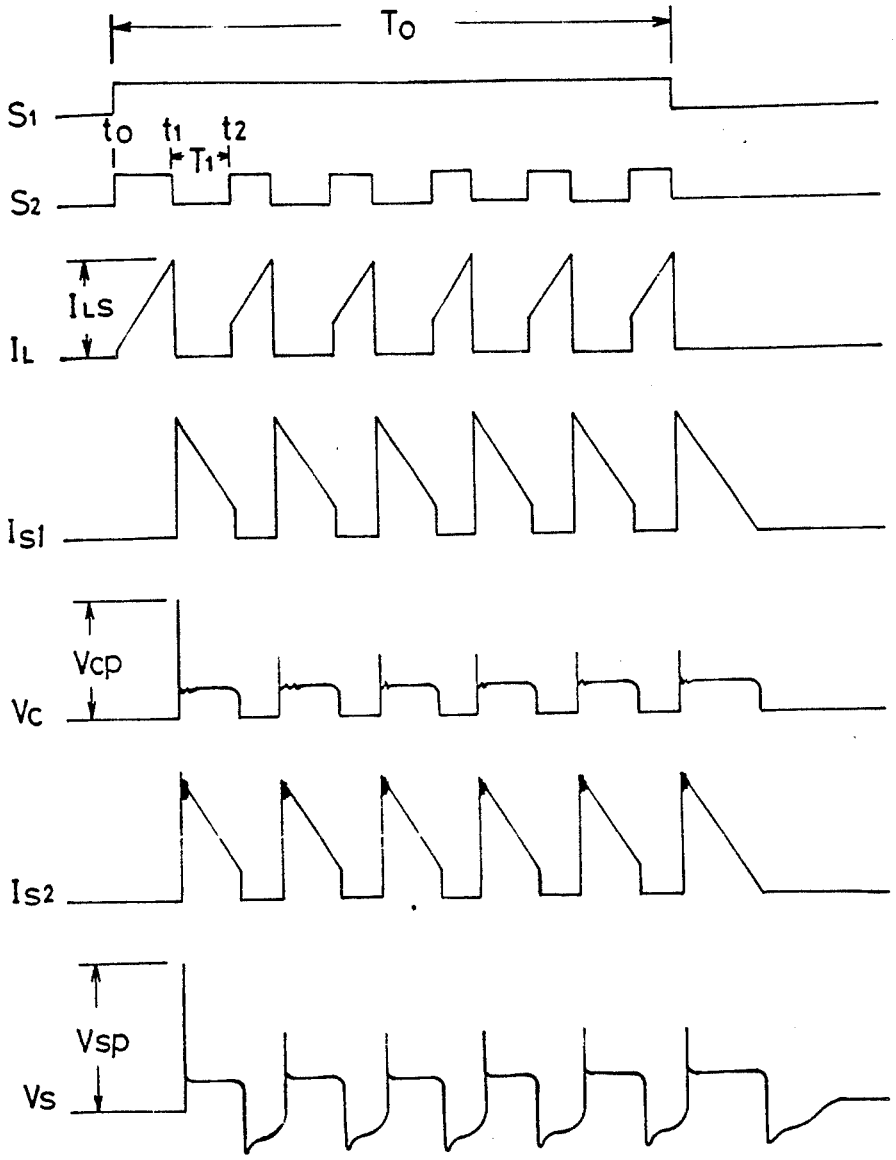
FIG. 2 shows, a waveform diagram of the waveform of each part of the ignition device in FIG. 1.

Referring to FIG. 2 for explaining the manner of the circuit, when the arc duration pulse (s1) is turned to high level at the time t0, the charge of the electromagnetic energy in the inductance coil 30 is started for the on driving of the switching transistor Tr. A negative direction current opposite to the dotted arrow in FIG. 1 does not flow in the primary winding 41 of the transformer 40due to diode 50. The current IL of the inductance coil 30 rises according to the following expression. (t is time and L is inductance of the coil 30)

$$IL = Va + t/L \quad (1)$$

The voltage between the terminals of the shunt resistor R rises with the increase of the current IL. The switching transistor Tr is turned off at time t1. The electromagnetic energy which is stored in the inductance coil 30 is discharged in the closed circuit which consists of the inductance coil 30 and primary winding 41. The current Is1 flows in the direction of the dotted arrow. The capacitance around the secondary winding 42 (floating capacitance of the secondary winding 42, electrostatic capacitance of the spark plug, etc.) is charged by the current Is1 through the transformer 40. The secondary voltage Vs of the secondary winding 42 rises. When the secondary voltage Vs reaches the dielectric breakdown voltage (about 20 kV) between the gap of the spark plug, a dielectric breakdown is generated. After that, while the energy stored in the inductance coil 30 is discharged, the secondary voltage Vs is held at a voltage (1–3kV) which is comparatively low.

After that, in the time t2 after lapse of the off time T1, the switching transistor Tr is driven on and supply of the electromagnetic energy is started again. However, current in the primary winding 41 does not flow past the diode 50. In this time, voltage added to inductance coil 30 is raised from battery voltage by the DC-DC converter 20 so that the charge speed is rapid.

When the dielectric breakdown occurs at the spark plug, voltage Vc is added to the collector of the switching transistor Tr. The voltage Vc is equal to the addition of the charge voltage to the voltage reflected from the secondary voltage Vs by the transformer 40. When the winding ratio of the transformer 40 is N, the voltage Vc is a value according to the following expression:

$$Vc = Va + Vs/N \quad (2)$$

The maximum value Tcp of the voltage Vc is expressed by the following equation:

$$Vcp = Va + Vsp/N \quad (3)$$

In the first embodiment, N is 100, VB is about 60 V. Then, the maximum of Vsp is about 40 kV, and the value of Vcp is about 460V. Accordingly, to protect the switching transistor Tr, a Zener diode ZD is inserted as a serge absorber between the ground and the inductance coil 30. The Zener voltage of the Zener diode ZD is larger than Vsp and is smaller than the breakdown voltage between the collector and the emitter of the transistor Tr.

Figure 3:
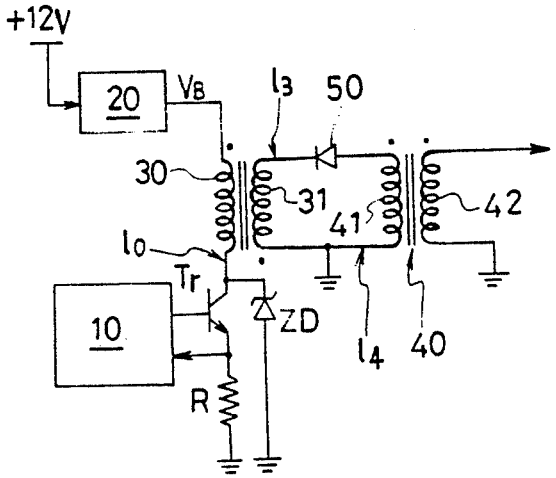
FIG. 3 shows a block diagram of the ignition device according to a second embodiment of the present invention.

The second embodiment of the ignition device according to this invention is shown in FIG. 3. In this embodiment, a coupled coil 31 is coupled magnetically to the inductance coil 30. The primary winding 41 is connected to the coupled coil 31. The diode 50 is inserted in a connection line 13. In the second embodiment, the energy stored in the inductance coil 30 is transmitted to the coupled coil 31, and is discharged to a closed loop comprises of the primary winding 41 and the coupled coil 31. In the charging term of the inductance coil 30, an electric connection between the coupled coil 31 and the transformer 40 is cut off by the diode.

The movement and action of the second embodiment are identical to that of the first embodiment. In the second embodiment, the ground side connection line 14 between the coupled coil 31 and the primary winding 41 can be omitted.

Figure 4:
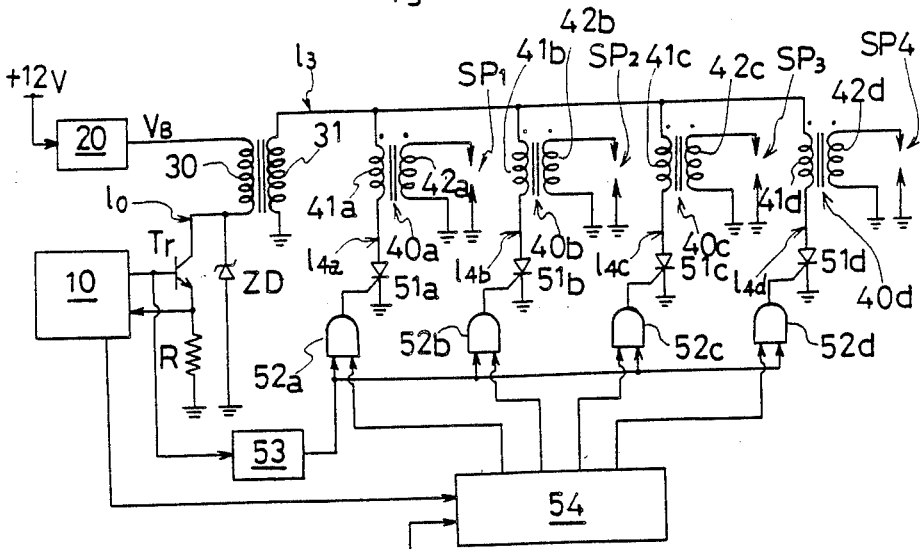
FIG. 4 shows a block diagram of the ignition device according to a third embodiment of the present invention.

FIG. 4 shows a third embodiment which is developed from the above second embodiment of this invention. This device is an ignition device for a 4 cylinder engine. In this device, four transformer coils **40*a*, 40*b*, 40*c* and 40*d* are connected to the coupled coil 31. Thyristors 51*a*, 51*b*, 51*c* and 51*d*** are inserted in the ground lines of the primary windings of these transformers.

A monostable multi-vibrator 53 is triggered by the negative edge of a signal s2 driving the base of the switching transistor Tr (the time is the moment the switching transistor Tr is driven off). The vibrator 53 outputs a high level drive pulse corresponding to the off-time T1 of the switching transistor Tr. The drive pulse is added to each input port of the AND gates **52*a*, 52*b*, 52*c* and 52*d***.

The output of the selector 54 is given in another input port of each AND gate. The selector 54 selects the AND gate corresponding to the cylinder which is to be ignited by the detected signal of the crank degree sensor. The selector outputs a high level selecting signal to the selected AND gate.

When the drive pulse from the vibrator 53 is added to the selected AND gate, the thyristor connected to the output end of the selected AND gate is driven on. The primary winding of the transformer correspond to the driving thyristor receives current while the other primary windings do not receive current. During the on-time of the switching transistor Tr, each thyristor is biased conversely and accordingly, all primary windings do not receive current. Thus, there is no energy loss against the inductance coil 30.

In this device, the rectification and selection are done by the thyristors **52*a*, 52*b*, 52*c* and 52*d***, so that the device may not need a distributor.

In the third embodiment, the transformers **40*a*, 40*b*, 40*c* and 40*d*** are disposed on each head of the respective spark plugs SP1, SP2, SP3 and SP4. Thus there is no need for the transformers to store energy, making it possible to use small transformers.

In the above embodiments, multi-spark discharges are generated in one ignition timing, but this invention may be applied to an ignition device which generates one spark discharge in one ignition timing.

Further, it is possible to use an oscillator as a means for repeating the driving on/off of the switching transistor Tr in one ignition timing and for generating plural spark discharges.

In this invention, the direction of the electromagnetic energy which is stored in the electromagnetic energy accumulator comprised of the inductance coil and the primary winding is controlled by a rectifier device, so that loss of the electromagnetic energy from the electromagnetic energy accumulator can be eliminated.

In this invention, the spark energy is maintained a long time by intermittent spark discharge when a large charge voltage is used to increase the charge speed in the case of using a device for generating multi-spark discharge in one ignition timing. In this case, it is possible to obtain a better igniting effect.

According to this invention, the ignition device is more reliable and efficient and has a good igniting effect and can be realized without a distributor.

While I have shown and described particular embodiments of my invention, it will be obvious to those skilled in the art that various changes and modifications may be made without departing from my invention in its broader aspects and I, therefore, intend in the appended claims to cover all such changes and modifications as fall within the true spirit and scope of my invention.

What is claimed is:

1. An ignition device for an internal combustion engine comprising:

electromagnetic energy accumulating means;

energy supplying means for supplying electromagnetic energy to the electromagnetic energy accumulating means;

switching means responsive to rotation of the engine for controlling the supply of energy from the supplying means to the accumulating means;

transformer means having a primary winding connected to the accumulating means, and a secondary winding for including a flow of electromagnetic energy in the secondary winding in response to the flow of electromagnetic energy in the primary winding;

rectifier means for controlling the direction of flow of the electromagnetic energy in the primary winding; and spark generating means connected to the secondary winding of the transformer means for generating an electric spark in response to the energy flowing in the secondary winding;

wherein the accumulating means includes an accumulation transformer having a coupled coil and means for electrically connecting the coupled coil with the primary winding, said coupled coil and said primary winding each being connected to ground and said rectifier means including a rectifier connected in series between the primary winding and ground;

wherein the transformer means includes a plurality of transformers, the spark generating means includes a corresponding plurality of spark generators, and the rectifier means includes an individual rectifier comprised of a thyristor corresponding to each transformer; and wherein said device also includes logic means connected to the switching means for controlling the operation of the individual thyristors in response to the rotation of the engine.

2. The device of claim 1 wherein the accumulating means includes a coil and means for connecting the coil in parallel with the primary winding and the rectifier means including a rectifier coupled in series to the connecting means between the coil and the primary winding.

3. The device of claim 1 wherein the rectifier means includes a rectifier electrically connected in series to the connecting means between the coupled coil and primary winding.

4. The device of claim 1 wherein the switching means includes transistor means for intermittently supplying energy from the supplying means, and switching driver means responsive to rotation of the engine for controlling the timing of the transistor means.

5. The device of claim 1 wherein the supplying means includes booster means for increasing the voltage level of the supplied electromagnetic energy.

6. The device of claim 1 wherein the rectifier means includes one of a diode, a thyristor and a transistor.

7. The device of claim 1 wherein the spark generating means includes a plurality of spark generators and the device also includes distributor means for controlling the timing of the spark generators.

8. The device of claim 1 wherein the logic means includes an AND gate corresponding to each thyristor.

* * * * *